US008233589B2

(12) United States Patent
Hauttmann

(10) Patent No.: US 8,233,589 B2
(45) Date of Patent: Jul. 31, 2012

(54) SCATTERED ELECTRON COLLECTOR

(75) Inventor: Stefan Hauttmann, Buchholz (DE)

(73) Assignee: Koninklijke Philips Electronics NV, Eindhoven (NL)

( * ) Notice: Subject to any disclaimer, the term of this patent is extended or adjusted under 35 U.S.C. 154(b) by 227 days.

(21) Appl. No.: 12/808,455

(22) PCT Filed: Dec. 12, 2008

(86) PCT No.: PCT/IB2008/055239

§ 371 (c)(1),
(2), (4) Date: Jun. 16, 2010

(87) PCT Pub. No.: WO2009/081312

PCT Pub. Date: Jul. 2, 2009

(65) Prior Publication Data

US 2010/0278309 A1 Nov. 4, 2010

(30) Foreign Application Priority Data

Dec. 19, 2007 (EP) ..... 07123721

(51) Int. Cl.
*H01J 35/16* (2006.01)

(52) U.S. Cl. ..... 378/142; 378/136; 378/140; 378/141

(58) Field of Classification Search ..... 378/136, 378/140, 141, 142
See application file for complete search history.

(56) References Cited

U.S. PATENT DOCUMENTS

| | | | | |
|---|---|---|---|---|
| 4,309,637 | A * | 1/1982 | Fetter | 378/130 |
| 6,215,852 | B1 * | 4/2001 | Rogers et al. | 378/142 |
| 6,301,332 | B1 | 10/2001 | Rogers et al. | |
| 6,400,799 | B1 * | 6/2002 | Andrews | 378/141 |
| 6,519,318 | B1 * | 2/2003 | Andrews | 378/141 |
| 6,619,842 | B1 * | 9/2003 | Artig et al. | 378/203 |
| 6,690,765 | B1 * | 2/2004 | Miller | 378/124 |
| 6,749,337 | B1 * | 6/2004 | Artig et al. | 378/203 |
| 6,980,628 | B2 | 12/2005 | Wang et al. | |
| 7,050,542 | B2 * | 5/2006 | Bathe et al. | 378/142 |
| 7,058,160 | B2 * | 6/2006 | Boye | 378/142 |
| 7,289,603 | B2 * | 10/2007 | Andrews et al. | 378/138 |
| 7,410,296 | B2 * | 8/2008 | Rogers | 378/203 |
| 7,486,774 | B2 * | 2/2009 | Cain | 378/136 |
| 7,688,949 | B2 * | 3/2010 | Warburton et al. | 378/140 |
| 7,983,395 | B2 * | 7/2011 | Saito | 378/140 |
| 8,000,450 | B2 * | 8/2011 | Andrews | 378/142 |
| 8,107,591 | B2 * | 1/2012 | Freudenberger et al. | 378/140 |

FOREIGN PATENT DOCUMENTS

| | | |
|---|---|---|
| EP | 1791159 | 5/2007 |
| WO | WO2006029026 | 3/2006 |

* cited by examiner

*Primary Examiner* — Allen C. Ho

(57) ABSTRACT

Scattered electron collector comprising a heat absorbing member having a first end, a second end, an outer periphery and a central bore (14, 16), wherein the central bore is formed in longitudinal direction through the heat absorbing member from the first end to the second end, and a cooling element (50) having an outer periphery and an inner periphery (52). The outer periphery (12) of the heat absorbing member is adapted to be in contact with the inner periphery of the cooling element. Further, at least one slot (20) is formed from the central bore in the direction to the outer periphery of the heat absorbing member to reduce compression stress within the heat absorbing member.

30 Claims, 8 Drawing Sheets

SCATTERED ELECTRON COLLECTOR

This invention relates generally to a scattered electron collector. Particularly, the invention relates to a scattered electron collector for use in a X-ray tube for generating X-rays.

TECHNOLOGICAL BACKGROUND

The future demands for high-end CT and CV imaging regarding the X-ray source are higher power/tube current, smaller focal spots (FS) combined with the ability of active FS size, ratio and position control, shorter times for cooling down, and concerning CT shorter gantry rotation times. In addition to this, the tube design is limited in length and weight to achieve an easy handling for CV application and a realizable gantry setup for CT applications.

One key to reach higher power and faster cooling is given by using a sophisticated heat management concept inside the X-ray tube. In bipolar X-ray tubes about 40% of the thermal load of the target is due to electrons backscattered from the target, which are reaccelerated towards the target and hitting it again outside the focal spot. Hence, these electrons contribute to the temperature increase of the target and causes off-focal radiation.

Therefore one key component of the currently developed new X-ray tube generation is a scattered electron collector (SEC) located in front of the target. Such a X-ray tube comprises a source for emitting electrons, a carrier which is rotatable about an axis of rotation and which is provided with a material which generates X-rays as a result of the incidence of electrons, a heat absorbing member arranged between the source and the carrier, and a cooling system which is in thermal connection with the heat absorbing member.

The source, the carrier, and the heat absorbing member are accommodated in a vacuum space of the device. The carrier is disc-shaped and is rotatably journalled by means of a bearing. During operation, an electron beam generated by the source passes through a central cavity provided in the heat absorbing member and impinges upon the X-ray generating material of the carrier in an impingement position near the circumference of the carrier. As a result, X-rays are generated in said impingement position, which emanate through an X-ray exit window provided in a housing enclosing the vacuum space. The heat absorbing member has the same electrical potential as the carrier and is arranged between the source and the carrier to catch electrons, which are scattered back from the carrier, and to absorb radiant heat generated by the carrier when heated during operation, as a result of which the heat absorbing member is heated during operation.

To lead the heat away from the heat absorbing member, a cooling system is attached to said member, which cooling system comprises a channel for a cooling liquid, which cooling system is provided in a circumferential portion of the heat absorbing member in direct thermal contact with the heat absorbing member. The heat absorbing member is made, for example, from Mo and has a relatively large mass and volume, so that the heat absorbing member has a large heat absorbing capacity. Thus, when the device is temporarily in operation to generate X-rays of a relatively high energy level, a relatively large rate of heat absorption by the heat absorbing member temporarily occurs. Further, the rate of heat transfer from the heat absorbing member to the cooling system is limited, and the heat absorbed by the heat absorbing member is gradually transferred to the cooling system during the time that the device generates X-rays and afterwards when the device is not in operation. As a result of said gradual transfer of the heat from the heat absorbing member to the cooling system, thermal peak loads on the cooling system are prevented, so that cooling system problems, such as boiling of the cooling liquid or melting of thin-walled structures of the cooling system, are prevented.

However, the thermal load of the target is in this case determined only by electrons contributing to the tube's X-ray output. The backscattered electrons release their energy at the SEC which is integrated into the tube's cooling system. The cooling walls of the SEC are located on the outer areas at bigger radius while the heat is generated on the inner areas at smaller radius. Therefore, the inner surface of the SEC heats up and expands during an X-ray pulse while the outer part does not expand. Hence, compression stress occurs during the pulse due to the closed inner surface. While cooling down the inner surface shrinks and the stress relaxes.

In addition to the heat management contribution the SEC may act essentially as an X-ray shielding in case it is made from metal with high melting point like Mo of W.

During a high energy pulse the compression stress may increase to a value where plastic deformation results. This effect relaxes the stress during the pulse. But when cooling down the surface shrinks which causes tensile stress within the inner surface. This could result immediately in crack formation or after a series of pulses in fatigue cracks. Gas eruptions may be the result which leads to high voltage instability (arcing) and gas ionization with following ion bombardment onto the emitter (emitter failure), i.e. the target. Besides that also small particles could be separated which leads to the same results when entering the electron beam.

SUMMARY OF THE INVENTION

An object of the invention is to provide a scattered electron collector (SEC) having reduced compression stress or expansion stress within its heat absorbing member during heating or cooling down of the SEC.

This object is solved by the subject matter of the respective independent claims. Further exemplary embodiments are described in the respective dependent claims.

The proposed invention relates to a geometrical change of the SEC to avoid the compression stress during an X-ray pulse. This is realized by introducing slots within the inner SEC part which leads to a mechanical non-constraining inner surface expansion without producing compression stress.

According to an embodiment of the invention, cutting of said volume is realized by straight slots in radial direction (exemplary 8 slots). The number of slots depends on the critical load case. In special cases one slot is enough. In this content radial means that the direction of the straight slot points towards the focal spot where the high energy electrons hit the target and produce X-rays.

According to another embodiment of the invention, the slots are tilted with respect to the radial direction, i.e., they are not anymore centric/radial. As an effect of such an arrangement, the X-ray shielding maintains almost constant in comparison to the non-slotted SEC. But it results in undercut corners (corner angle less than 90°). As long as the main surface temperature is not close to a critical value, this geometry is best to avoid crack formation while maintaining X-ray shielding.

According to yet another embodiment of the invention, the slots are curved. Specially, the slots start in radial direction from the inner bore and are bended to the circumferential direction, in the direction to the outer periphery. That guarantees a homogeneous temperature on the inner surface and reduces the shielding reduction. Such a geometry could be realized, for example, by wire EDM (Electric Discharge Machining).

Generally, a scattered electron collector according to the invention comprises a heat absorbing member having a first end, a second end, an outer periphery and a central bore, wherein the central bore is formed in longitudinal direction through the heat absorbing member from the first end to the second end, and a cooling element having an outer periphery and an inner periphery, wherein the outer periphery of the heat absorbing member is adapted to be in contact with the inner periphery of the cooling element, and wherein a slot is formed from the central bore in the direction to the outer periphery of the heat absorbing member.

The slot can be formed from the central bore in radial direction to the outer periphery of the heat absorbing member or inclined with respect to the radial direction or curved from the radial direction to the circumferencial direction Further, there can be a plurality of slots formed in the heat absorbing member, which might be evenly distributed at the circumference of the heat absorbing member.

Especially, at the end of each slot can be formed a drilling having a diameter greater than the thickness of the slot, wherein the axis of the drilling can be inclined with respect to the axis of the central bore.

Further, the central bore of the heat absorbing member might comprise a cylindrical section and a conical section, wherein one end of the cylindrical section is located at the first end of the heat absorbing member, wherein the other end of the cylindrical section merges into the end of the conical section having a small diameter, and wherein the end of the conical section having a great diameter is located at the second end of the heat absorbing member.

The cooling element can be ring-shaped and might comprise a plurality of cooling rips at the outer periphery thereof.

The slots could also cut the entire inner part of the heat absorbing member.

The invention would be applicable to any field in which an electron collector with a collecting inner surface ($\phi$=0°-360° in cylindrical coordinates) is heated while an outer surface is cooled. Additionally it is applicable if this collector is also used as an X-ray shielding. Especially it is applicable in the CV and CT version of the new X-ray tube generation.

These and other aspects of the invention will be apparent from and elucidated with reference to the embodiment described hereinafter.

BRIEF DESCRIPTION OF THE DRAWING

In the following, the invention will be described by means of an exemplary embodiment with regard to the attached figures.

DETAILED DESCRIPTION OF EXEMPLARY EMBODIMENTS

Figure 1:
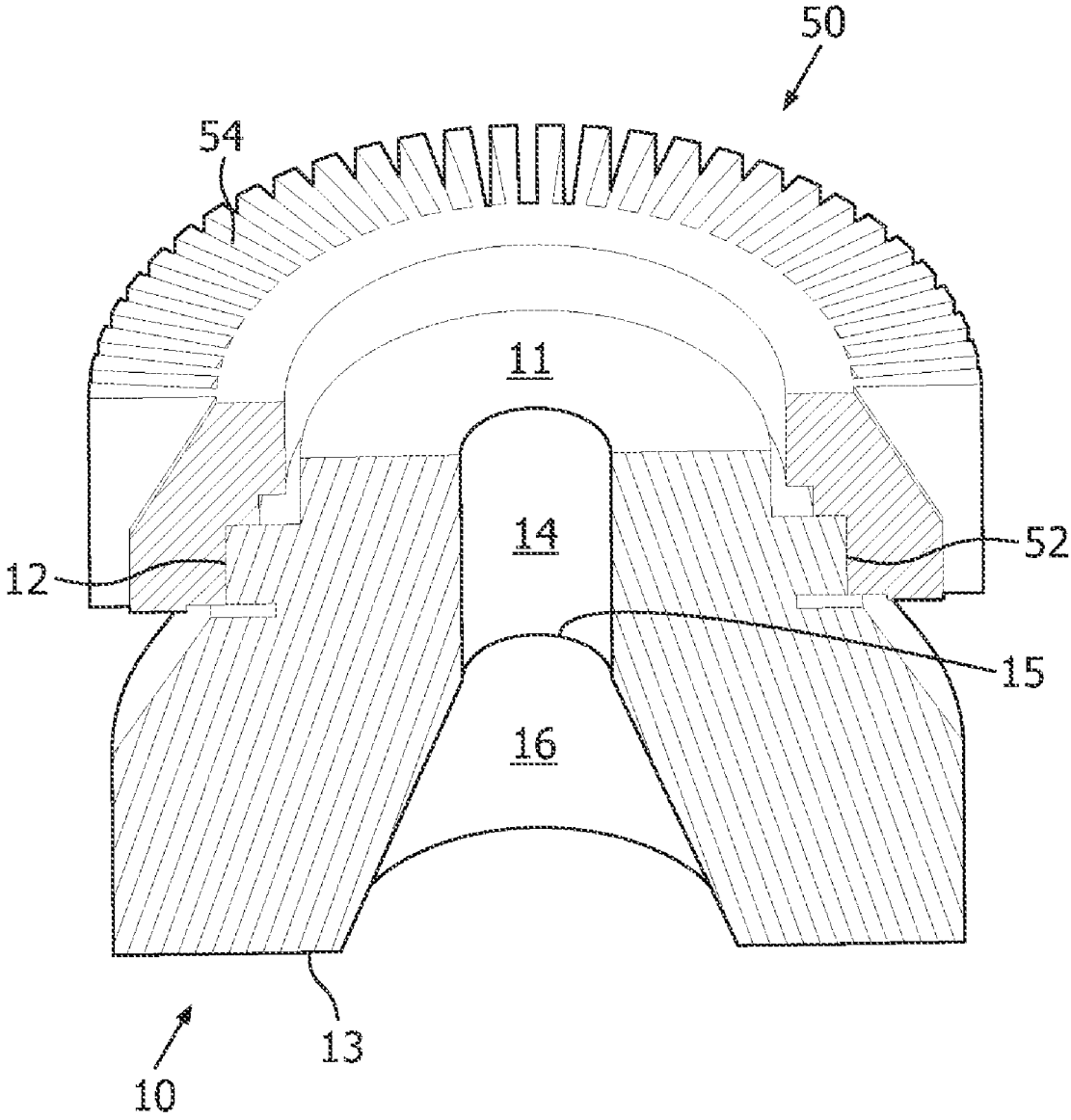
FIG. 1 is an isometric sectional view of the general elements of a SEC.

Generally, a scattered electron collector (SEC) includes a heat absorbing member 10 and a cooling element 50, as can be seen in FIG. 1. The heat absorbing member 10 is essentially cylindrical and has a central bore. The central bore of the heat absorbing member 10 comprises a cylindrical section 14 and a conical section 16. The cylindrical section 14 extends in longitudinal direction from a first end 11 of the heat absorbing member 10 to, approximately, the middle 15 of the heat absorbing member. The conical section 16 of the central bore extends from said middle 15 of the heat absorbing member 10 to the second end 13 of the heat absorbing member 10.

Alternatively, the central bore might be formed with a varying cross section along its longitudinal direction, in the shape of a wine glass. Further, instead of the conical section, there might be a section formed like a dome. In either case, a greater open end is formed at the second end of the heat absorbing member.

The funnel which is formed by the conical section 16 of the central bore is arranged over the point which emits the scattered electrons (focal spot). This way the electrons are gathered like of a hood. The electrons or photons hit the heat absorbing member 10 of the SEC and will be absorbed by means of it.

For the better derivation of the heat from the heat absorbing member a cooling element 50 is scheduled at its outer size. The cooling element 50 is essentially ring-like and includes an inner diameter 52 which matches with the outer periphery 12 of the heat absorbing member 10 so that the cooling element 50 can be put on and in contact with the heat absorbing member 10. Since the cooling element 50 is in contact with the heat absorbing member 10, it can derive the heat from the heat absorbing member. The cooling element 50 has a plurality of cooling fins 54 on its outer periphery. These cooling fins 54 can derive the heat from the cooling element 50 to a fluid. The fluid can be, for example, air or also a liquid. If the fluid is a liquid, it is important that this liquid remains below its boiling temperature. The cooling element 50 can derive only as much energy as possible, while maintaining the cooling fluid below its boiling temperature. The contact surface between the heat absorbing member 10 and the cooling element 50 should correspondingly be calculated so that only an amount of energy/heat which can also be transported by the liquid away from the cooling element, will be transfer to the cooling element.

As mentioned above, it can occur in the heat absorbing member 10 of a SEC, that the inner wall of the heat absorbing member heated up too strongly and therefore tensions are formed in the material. In accordance with a first embodiment of the invention the heat absorbing member is provided with at least one slot within its inside. Usually, the heat absorbing member will be provided with a plurality of slots. In accordance with a preferred embodiment the heat absorbing member is provided with eight slots. The slots are formed respectively from the central bore in the direction of the outer periphery of the heat absorbing member.

Figure 2:
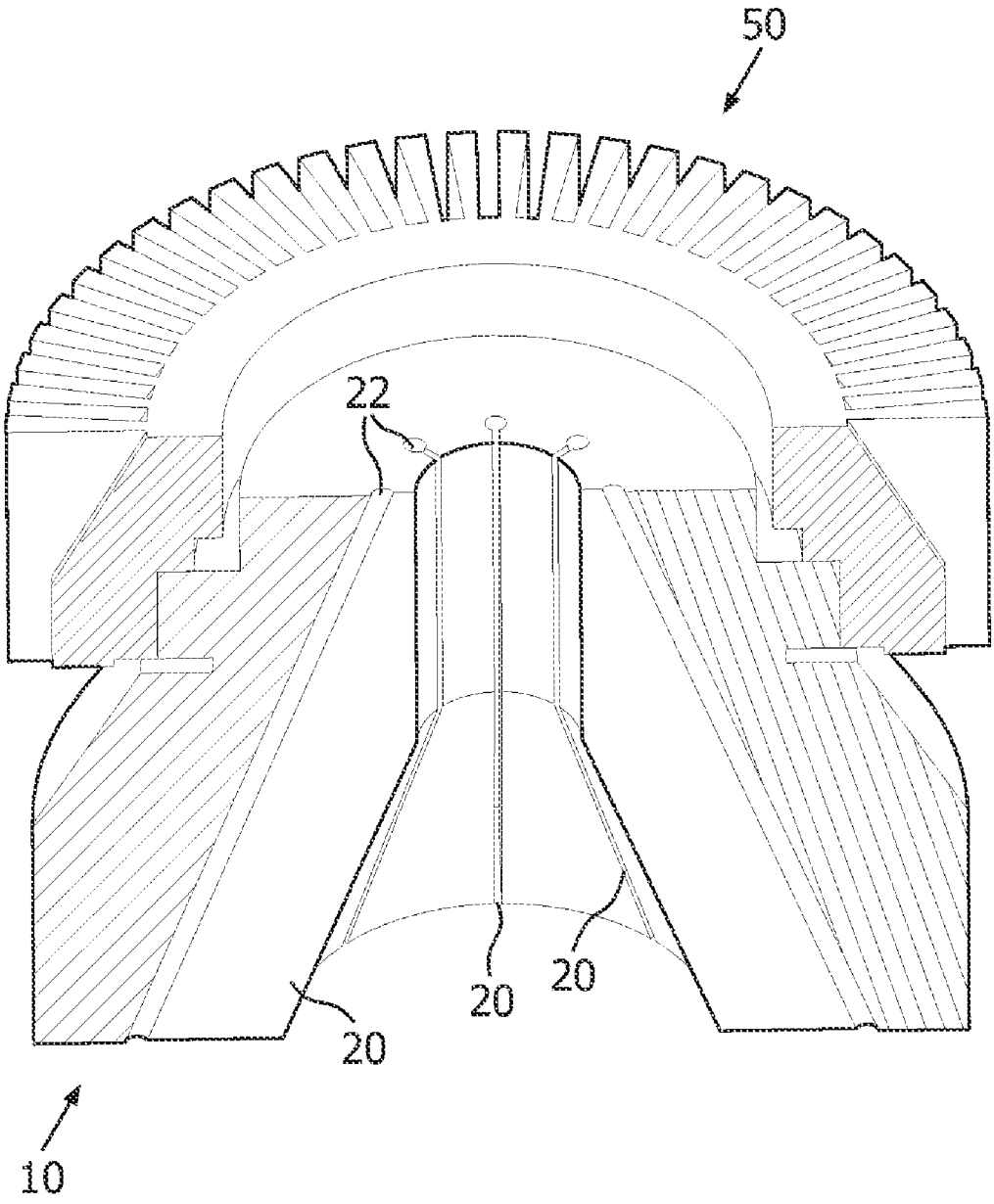
FIG. 2 is an isometric sectional view of a SEC according to a first embodiment of the invention.
Figure 3:
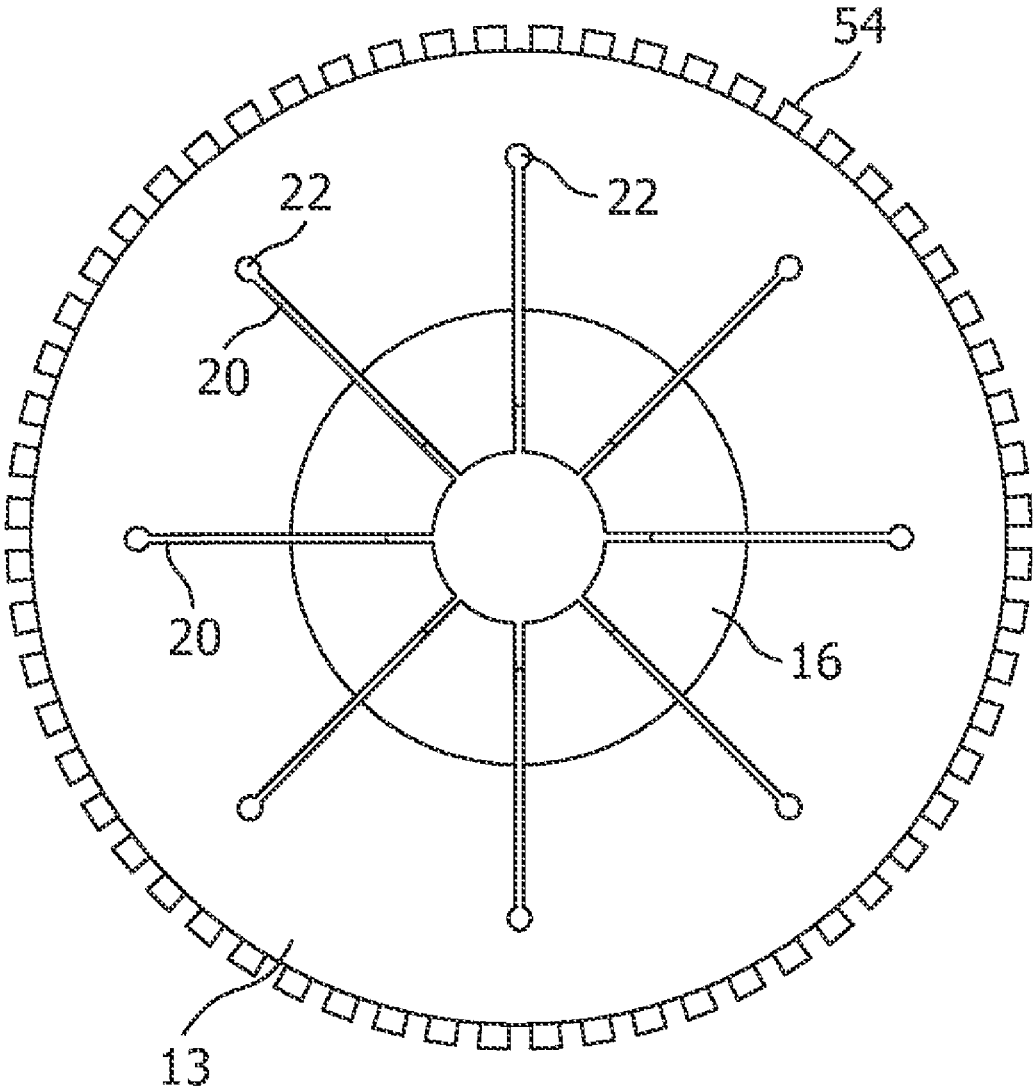
FIG. 3 is a bottom view of the SEC of FIG. 2.
Figure 4:
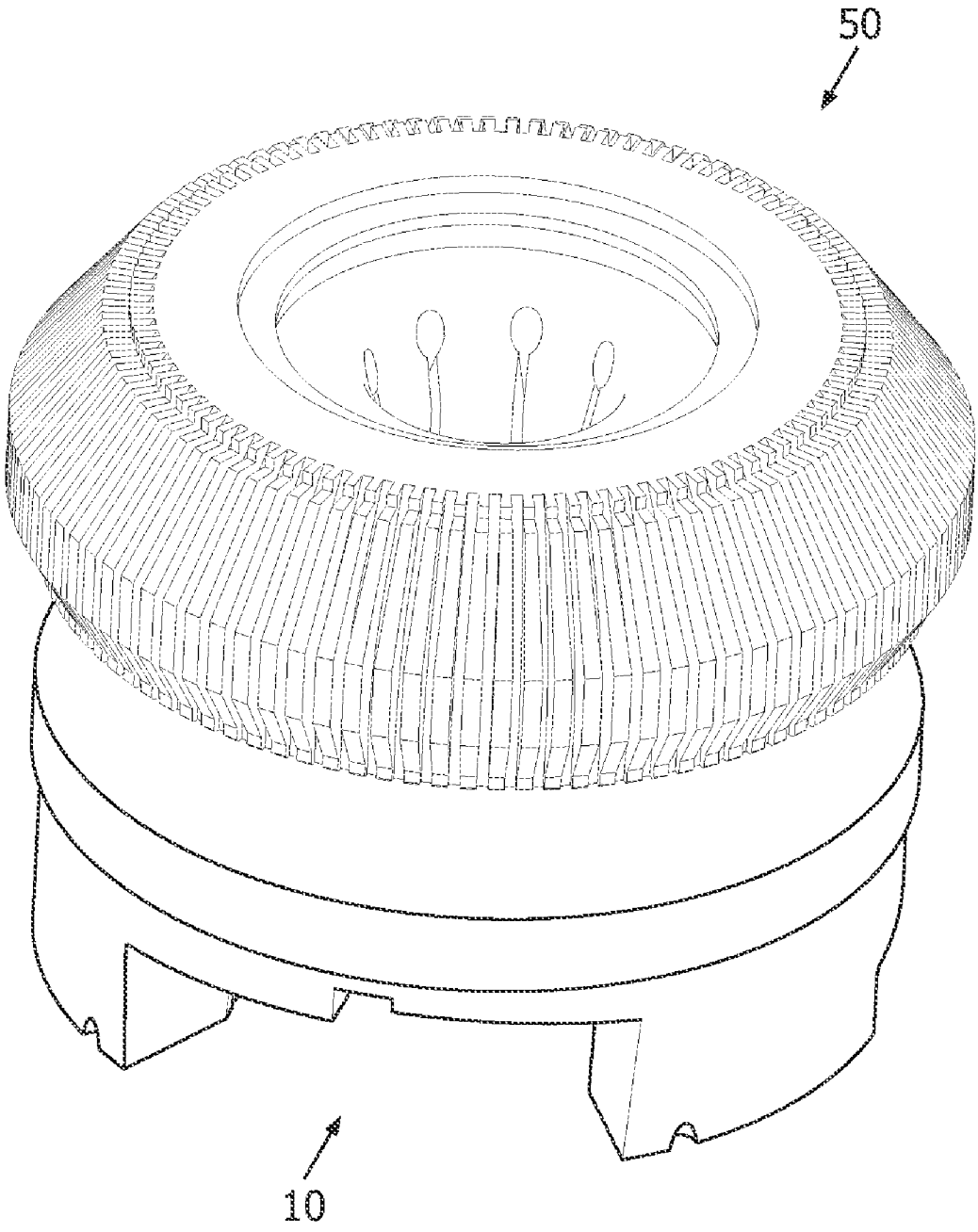
FIG. 4 is a isometric view of the SEC of FIG. 2.

As shown in FIGS. 2 to 4, according to a first embodiment, every slot 20 is formed radially from the central bore in the direction to the outside of the heat absorbing member 10. The slots 20 are generally formed not completely though the wall. I.e., each slot 20 includes an end which is open to the central bore, and an end within the heat absorbing member. Each slot has the effect that tensions in the material due to the strong heating of the material are reduced.

A reduction of the tensions in the material of the heat absorbing member can be reached if the end of every slot 20, which end is located within the heat absorbing member, leads into a small drilling 22. This drilling 22 has a diameter which is greater than the width of the respective slot 20. This way carving effects due to the slots in the material are prevented. The axis of each small drilling 22 can be arranged parallel to the axis of the central bore. The axis of the drilling is preferably arranged at an angle to the axis of the central bore. To reach a distribution, as uniform as possible, of the heat and, thus, of the tensions in the material of the heat absorbing member, the small drilling 22 should be arranged parallel to the inclination of the conical section 16 of the central bore. Every slot is formed between the central bore and a small drilling.

Figure 5:
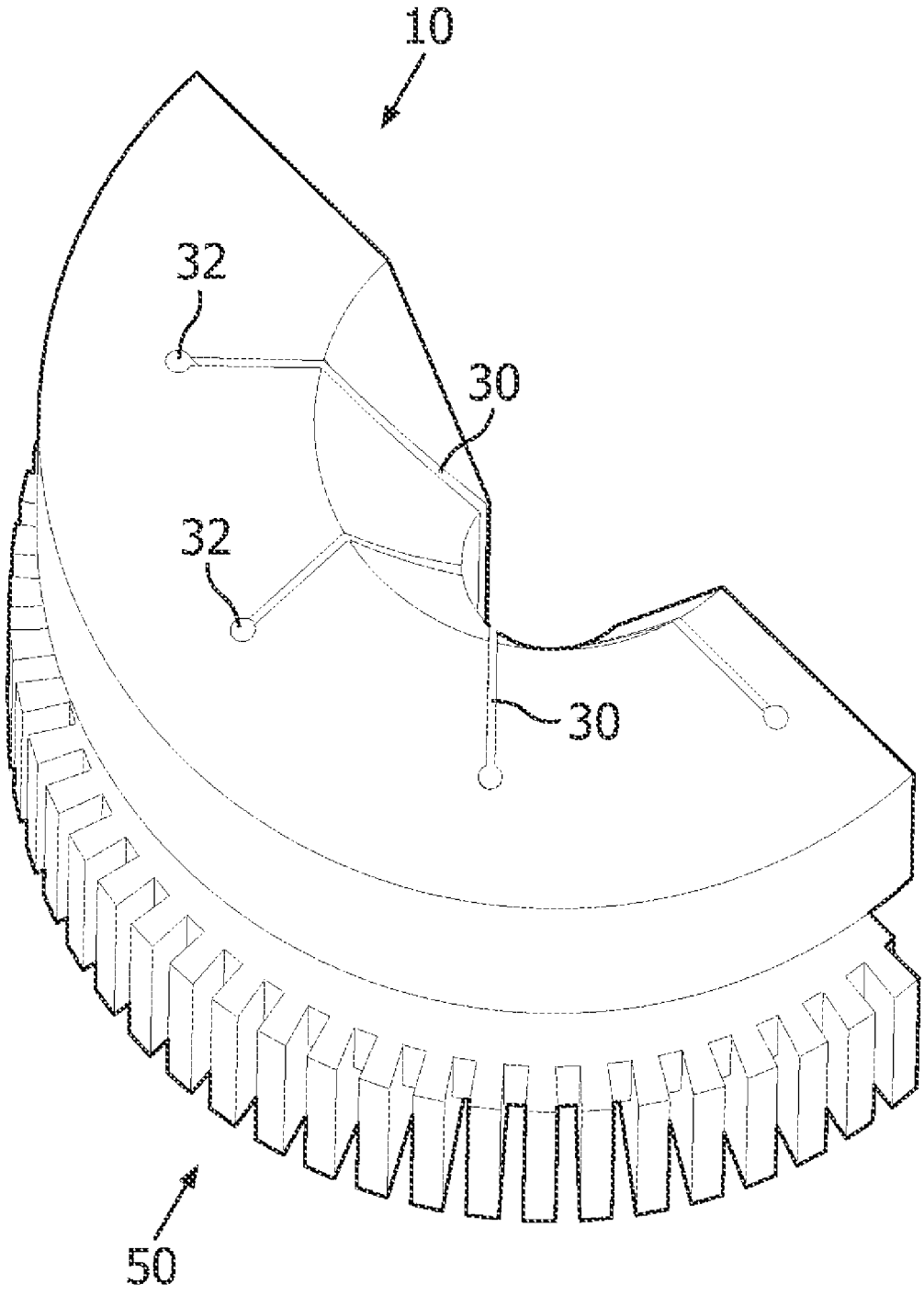
FIG. 5 is an isometric half illustration of a SEC according to a second embodiment of the invention.
Figure 6:
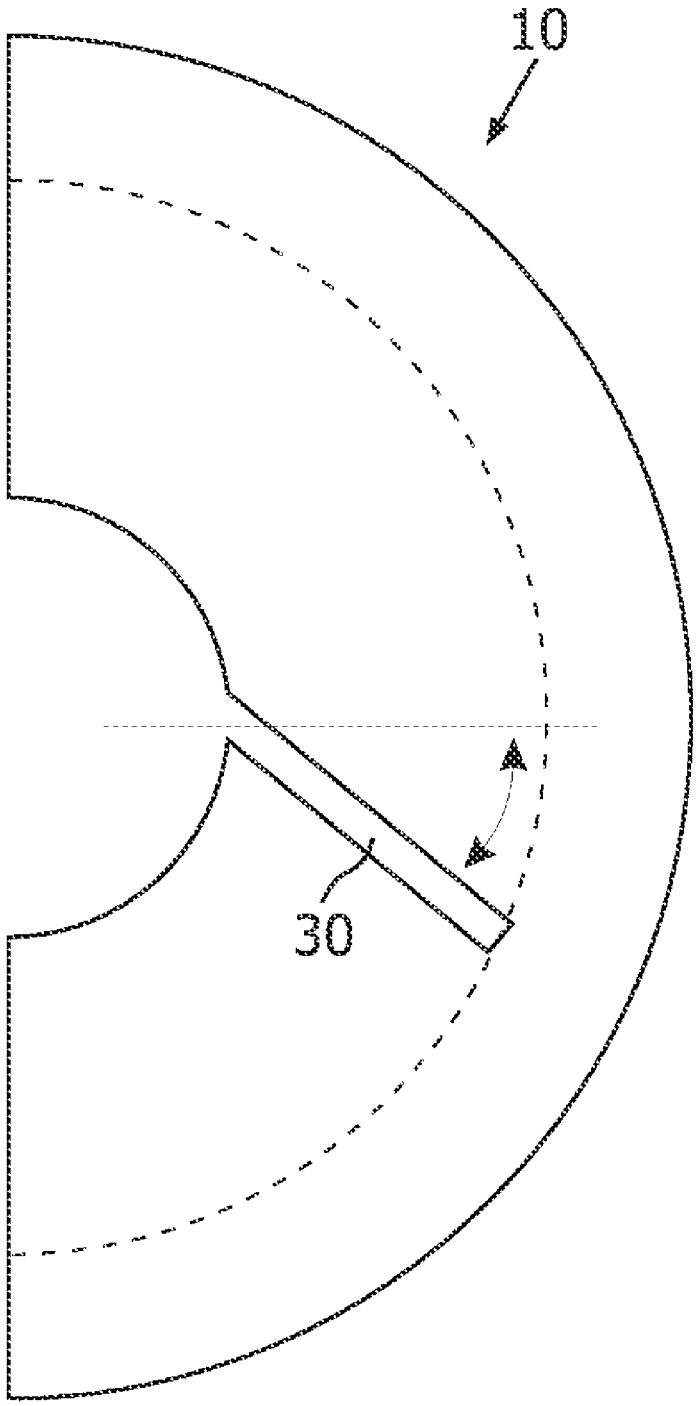
FIG. 6 is an illustration showing the orientation of an exemplary slot according to the second embodiment.

As shown in FIGS. 5 and 6, in accordance with a second embodiment of the invention each of the slots 30 can be formed at an angle with respect to the radial direction. Therefore, the slots 30 start at the central bore in the heat absorbing member and proceeds with an angle to the radial direction, in the direction of the outer periphery of the heat absorbing member. Slot 30 leads to a small drilling 32 This has the advantage that those electrons which meet the entrance of a slot at the central bore, might be absorbed reliably. The inclined course of each slot makes sure that the electrons impinge a wall which is thick enough to sufficiently absorb the electrons and X-rays.

Figure 7:
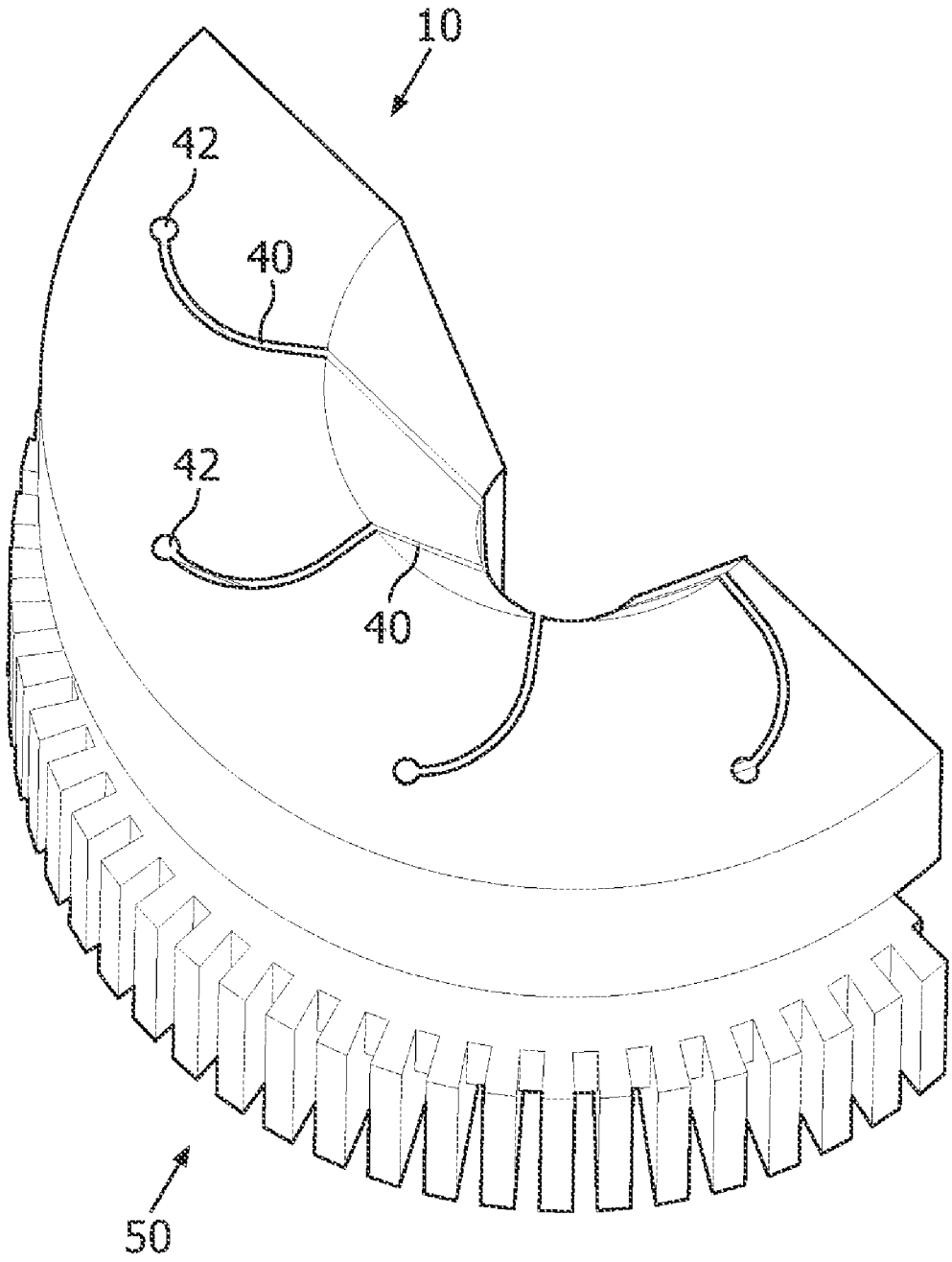
FIG. 7 is an isometric half illustration of a SEC according to a third embodiment of the invention
Figure 8:
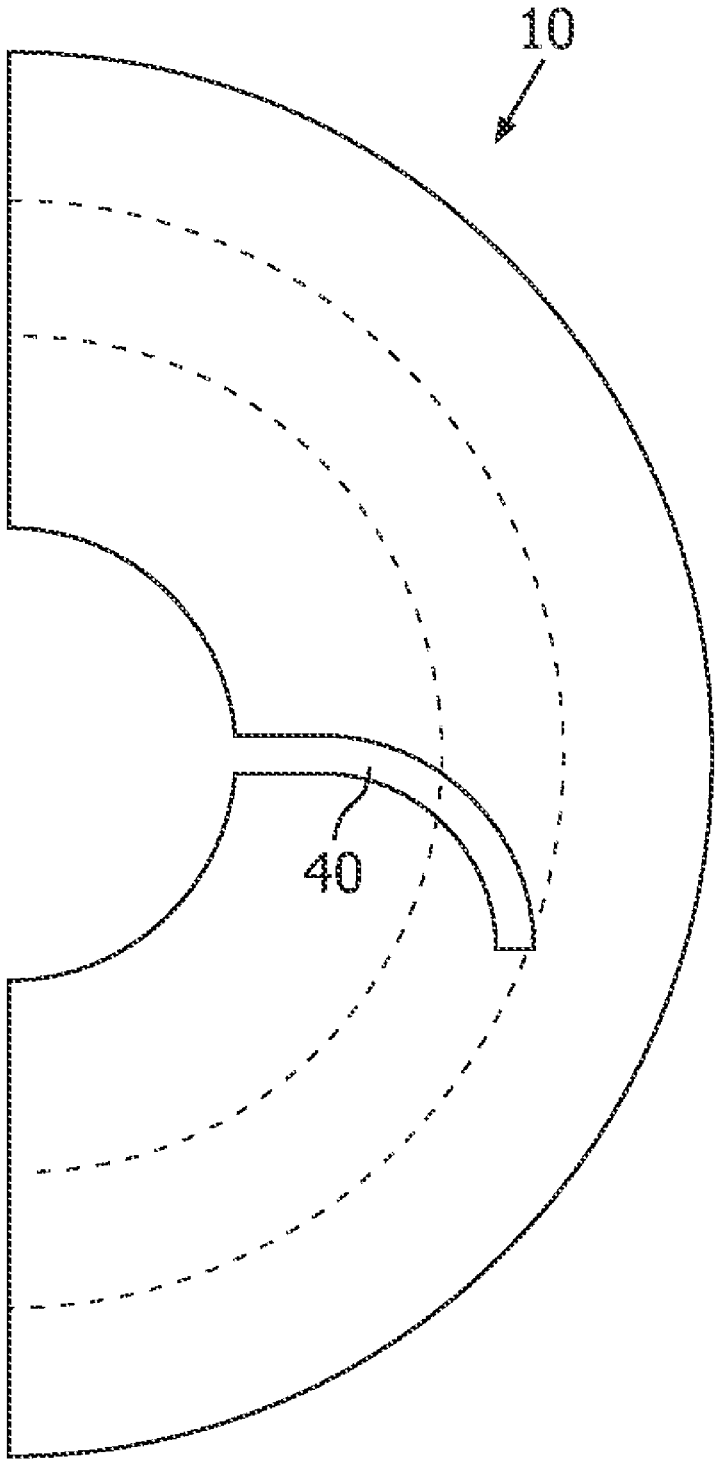
FIG. 8 is an illustration showing the course of an exemplary slot according to the third embodiment.

As shown in FIGS. 7 and 8, in accordance with a third embodiment of the invention each of the slots 40 is formed at a bended course in the heat absorbing member 10. According to said embodiment, the slots 40 are formed firstly in a radial direction starting at the central bore, and then follow a bended course within the material of the heat absorbing member, as exemplarily shown in FIG. 8. Every slot 40 describes a bend between the radial direction and, approximately, the circumferential direction of the heat absorbing member. Slot 40 leads to a small drilling 42 Therefore it is prevented, on the one hand, that sharp angles result between the central bore and the slots, which angles might lead to an uneven distribution of the heat dissipation within the material. On the other hand, a sufficient material thickness is provided which reliably collects all electrons which are scattered, as well as X-rays. As in all embodiments, a cooling element is provided on the outer side of the heat absorbing member to cool down the heat absorbing member in shorter time.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single element may fulfill the functions of several items recited in the claims. The mere fact that certain measures are recited in mutually different dependent claims does not indicate that a combination of these measured cannot be used to advantage. Any reference signs in the claims should not be construed as limiting the scope.

The invention claimed is:

1. A scattered electron collector comprising:

a heat absorbing member having a first end, a second end, an outer periphery and a central bore, wherein the central bore is formed in longitudinal direction through the heat absorbing member from the first end to the second end; and a cooling element having an outer periphery and an inner periphery;

wherein the outer periphery of the heat absorbing member is adapted to be in contact with the inner periphery of the cooling element; and wherein a slot is formed from the central bore in the direction to the outer periphery of the heat absorbing member.

2. The scattered electron collector of claim 1, wherein the slot is formed from the central bore in radial direction to the outer periphery of the heat absorbing member.

3. The scattered electron collector of claim 1, wherein a plurality of slots are formed from the central bore in radial direction to the outer periphery of the heat absorbing member.

4. The scattered electron collector of claim 3, wherein the slots are evenly distributed at the circumference of the heat absorbing member.

5. The scattered electron collector of claim 1, wherein eight slots are formed from the central bore in radial direction to the outer periphery of the heat absorbing member.

6. The scattered electron collector of claim 1, wherein at the end of the slot is formed a drilling having a diameter greater than the width of the slot.

7. The scattered electron collector of claim 6, wherein the axis of the drilling is inclined with respect to the axis of the central bore.

8. The scattered electron collector of claim 1, wherein the central bore of the heat absorbing member comprises a cylindrical section and a conical section, wherein one end of the cylindrical section is located at the first end of the heat absorbing member, wherein the other end of the cylindrical section merges into the end of the conical section having a small diameter, and wherein the end of the conical section having a great diameter is located at the second end of the heat absorbing member.

9. The scattered electron collector of claim 1 wherein the cooling element is ring-shaped.

10. The scattered electron collector of claim 1, wherein the cooling element comprises a plurality of cooling fins at the outer periphery thereof.

11. The scattered electron collector of claim 1, wherein the slot is formed from the central bore, inclined with respect to the radial direction, and in a direction to the outer periphery of the heat absorbing member.

12. The scattered electron collector of claim 11, wherein a plurality of slots are formed from the central bore in radial direction to the outer periphery of the heat absorbing member.

13. The scattered electron collector of claim 12, wherein the slots are evenly distributed at the circumference of the heat absorbing member.

14. The scattered electron collector of claim 11, wherein eight slots are formed from the central bore in radial direction to the outer periphery of the heat absorbing member.

15. The scattered electron collector of claim 11, wherein at the end of the slot is formed a drilling having a diameter greater than the width of the slot.

16. The scattered electron collector of claim 15, wherein the axis of the drilling is inclined with respect to the axis of the central bore.

17. The scattered electron collector of claim 11, wherein the central bore of the heat absorbing member comprises a cylindrical section and a conical section, wherein one end of the cylindrical section is located at the first end of the heat absorbing member, wherein the other end of the cylindrical section merges into the end of the conical section having a small diameter, and wherein the end of the conical section having a great diameter is located at the second end of the heat absorbing member.

18. The scattered electron collector of claim 11 wherein the cooling element is ring-shaped.

19. The scattered electron collector of claim 11, wherein the cooling element comprises a plurality of cooling fins at the outer periphery thereof.

20. The scattered electron collector of claim 1, wherein the slot is formed beginning in radial direction from the central bore and curved in direction of the circumference of the heat absorbing member.

21. The scattered electron collector of claim 20, wherein a plurality of slots are formed from the central bore in radial direction to the outer periphery of the heat absorbing member.

22. The scattered electron collector of claim 21, wherein the slots are evenly distributed at the circumference of the heat absorbing member.

23. The scattered electron collector of claim 20, wherein eight slots are formed from the central bore in radial direction to the outer periphery of the heat absorbing member.

24. The scattered electron collector of claim 20, wherein at the end of the slot is formed a drilling having a diameter greater than the width of the slot.

25. The scattered electron collector of claim 24, wherein the axis of the drilling is inclined with respect to the axis of the central bore.

26. The scattered electron collector of claim 20 wherein the central bore of the heat absorbing member comprises a cylindrical section and a conical section, wherein one end of the cylindrical section is located at the first end of the heat absorbing member, wherein the other end of the cylindrical section merges into the end of the conical section having a small diameter, and wherein the end of the conical section having a great diameter is located at the second end of the heat absorbing member.

27. The scattered electron collector of claim 20 wherein the cooling element is ring-shaped.

28. The scattered electron collector of claim 20, wherein the cooling element comprises a plurality of cooling fins at the outer periphery thereof.

29. A scattered electron collector according to claim 1 for use in a X-ray source.

30. A X-ray source having a scattered electron collector according to claim 1.

* * * * *